US005439734A

United States Patent [19]

Everhart et al.

[11] Patent Number: 5,439,734

[45] Date of Patent: Aug. 8, 1995

[54] NONWOVEN FABRICS HAVING DURABLE WETTABILITY

[75] Inventors: Dennis S. Everhart, Alpharetta, Ga.; Randy E. Meirowitz, Neenah, Wis.

[73] Assignee: Kimberly-Clark Corporation, Neenaah, Wis.

[21] Appl. No.: 135,823

[22] Filed: Oct. 13, 1993

[51] Int. Cl.[6] ..... A47L 13/16; A61F 13/36; A61L 15/42; D04H 3/16; H01M 2/16

[52] U.S. Cl. ..... 428/224; 15/209.1; 156/62.4; 428/288; 429/250; 604/372; 604/378

[58] Field of Search ..... 428/224, 288, 289; 156/62.4; 429/250; 15/209.1; 604/372, 378

[56] References Cited

U.S. PATENT DOCUMENTS

| | | | |
|---|---|---|---|
| 3,692,618 | 9/1972 | Dorschner et al. . | |
| 3,847,676 | 11/1974 | Palmer et al. | 136/148 |
| 3,849,241 | 11/1974 | Butin et al. . | |
| 3,870,567 | 3/1975 | Palmer et al. | 136/148 |
| 3,918,995 | 11/1975 | Palmer et al. | 136/145 |
| 3,933,525 | 2/1976 | Palmer et al. | 136/146 |
| 3,973,068 | 8/1976 | Weber | 428/198 |
| 4,070,218 | 1/1978 | Weber | 156/167 |
| 4,340,563 | 7/1982 | Appel et al. | 264/518 |
| 4,486,552 | 12/1984 | Niemann | 523/169 |
| 4,578,414 | 3/1986 | Sawyer et al. | 524/310 |
| 4,808,188 | 2/1989 | Ledford et al. | 8/115.68 |
| 4,857,251 | 8/1989 | Nohr et al. | 264/103 |
| 4,933,229 | 6/1990 | Insley et al. | 428/224 |
| 5,033,172 | 7/1991 | Harrington | 28/107 |
| 5,057,262 | 10/1991 | Nohr et al. | 264/211 |
| 5,079,080 | 1/1992 | Schwarz | 428/288 |
| 5,087,520 | 2/1992 | Suzuki et al. | 428/389 |
| 5,093,197 | 3/1992 | Howard et al. | 428/372 |
| 5,120,888 | 6/1992 | Nohr et al. | 524/99 |
| 5,126,219 | 6/1992 | Howard et al. | 429/252 |
| 5,145,727 | 9/1992 | Potts et al. | 428/198 |
| 5,149,576 | 9/1992 | Potts et al. | 428/198 |
| 5,200,130 | 4/1993 | Meirowitz et al. | 264/232 |

FOREIGN PATENT DOCUMENTS

0516271A1 12/1992 European Pat. Off. .

*Primary Examiner*—James C. Cannon
*Attorney, Agent, or Firm*—James B. Robinson

[57] ABSTRACT

There is provided a nonwoven fabric having durable wettability comprising fibers formed from polyolefin blended with hydrophilic additives of the formula;

$$[[R-\overset{\overset{\displaystyle O}{\|}}{C}-O]_A-[[CH_2-CH_2-O]_x]_B[-\overset{\overset{\displaystyle O}{\|}}{C}-R]_C]_z$$

wherein x is an integer from 1 to 15 and R is an alkane or alkene with up to 18 carbon atoms, A, B, and C are integers equal to or greater than one arranged in any order or repetitive series, z is an integer at least equal to one, and wherein the fibers which have been formed are polyolefin provided with hydrophilic additives prior to fiberization. Such fabrics have been found to provide surprisingly durable wettability.

9 Claims, No Drawings

NONWOVEN FABRICS HAVING DURABLE WETTABILITY

BACKGROUND OF THE INVENTION

The present invention relates to improved nonwoven fabrics or webs which are formed by extruding thermoplastic polymer filaments which can be conveyed onto a "forming wire" and bonded to provide structural integrity or extruded as filaments as use in other structures, for example, sliver, staple, and tow.

The use of thermoplastic polymers to form fibers and fabrics as well as a variety of shaped objects is well known. Common thermoplastic polymers for these applications have been polyolefins, particularly polyethylene and polypropylene. Polyolefins as a class tend to be hydrophobic materials and as such are relatively nonwettable by water, making fibers or fabrics made from these materials less than completely suitable for applications which call for wettability. Such applications are as absorbent products like diapers, feminine hygiene products, incontinence products and bandages which generally employ materials which exhibit hydrophilic characteristics. Despite their hydrophobic character, however, polyolefins continue to be the most common thermoplastic fiber forming polymer because of their low cost. As a result, a number of attempts have been made to provide a polyolefin fiber and fabric made therefrom which are hydrophilic and wettable.

In the applications mentioned above as well as others, the product, for example a diaper, may receive multiple liquid insults before disposal. It is important, therefore, that wettability, once imparted to a polyolefin, be durable. A wettable polyolefin in which the property of wettability was substantially reduced or even removed completely after one or even two wettings would probably be of very limited utility for applications with multiple insults. Durable wettability is defined therefore as the ability to become wet after at least three prior wettings.

It is an object of this invention to provide a polyolefin fabric and fiber having durable wettability and which is relatively simple in execution, i.e., requiring no extraordinary post-treatment of the fibers. It is a further object of this invention to provide a polyolefin fiber having durable wettability.

SUMMARY OF THE INVENTION

The objects of the invention are realized by a nonwoven fabric having durable wettability comprising fibers formed from polyolefin blended with hydrophilic additives of the formula;

$$[[R-\overset{\overset{\displaystyle O}{\|}}{C}-O]_A-[[CH_2-CH_2-O]_x]_B[-\overset{\overset{\displaystyle O}{\|}}{C}-R]_C]_z$$

wherein x is an integer from 1 to 15, R is an alkane or alkene with up to 18 carbon atoms, A, B, and C are integers equal to or greater than one and may be arranged in any order, z is an integer equal to or greater than one, and wherein the fibers which have been formed are polyolefin provided with hydrophilic additives prior to fiberization.

DETAILED DESCRIPTION OF THE INVENTION

As used herein the term "nonwoven fabric or web" means a web having a structure of individual filaments, fibers or threads which are interlaid, but not in a regular manner such as in knitting and weaving. Nonwoven fabrics or webs have been formed from many processes such as for example, meltblowing processes, spunbonding processes, and bonded carded web processes.

As used herein the term "meltblown fibers" means fibers formed by extruding a molten thermoplastic material through a plurality of fine, usually circular, die capillaries as molten threads or filaments into a high velocity gas (e.g. air) stream which attenuates the filaments of molten thermoplastic material to reduce their diameter, which may be to microfiber diameter. Thereafter, the meltblown fibers are carried by the high velocity gas stream and are deposited on a collecting surface to form a web of disbursed meltblown fibers. Such a process is disclosed, for example, in U.S. Pat. No. 3,849,241 to Butin.

As used herein the term "spunbonded fibers" refers to small diameter fibers which are formed or "spun" by extruding molten thermoplastic material as filaments from a plurality of fine, usually circular capillaries of a spinnerette with the diameter of the extruded filaments then being rapidly reduced as by, for example, in U.S. Pat. No. 4,340,563 to Appel et al., and U.S. Pat. No. 3,692,618 to Dorschner et al. The "bonding" step of spunbonding is usually accomplished thermally by passing the spun fabric between the rolls of a heated calender. Various patterns can be imparted to the fabric by the calender rolls but the principle purpose of bonding is to increase the integrity of the fabric. The bond area in thermal bonding is usually about 15% but may vary widely depending on the desired web properties. Bonding may also be done by needling, hydroentanglement or other methods known to those skilled in the art though the method used in this invention is preferably thermal calender bonding. The spunbonding process is well known in the art.

As used herein the term "polymer" generally includes but is not limited to, homopolymers, copolymers, such as for example, block, graft, random and alternating copolymers, terpolymers, etc. and blends and modifications of any of the foregoing. Furthermore, unless otherwise specifically limited, the term "polymer" shall include all possible geometrical configuration of the material. These configurations include, but are not limited to isotactic, syndiotactic and random symmetries.

Thermoplastic polymers, particularly polyolefins are well known in the art for fabricating shaped articles as well as for fiberization. It is believed that any polyolefin capable of being fiberized is suitable for use in this invention. Examples of suitable polyolefins include homopolymers and copolymers of one or more aliphatic hydrocarbon, including, for example, ethylene, propylene, butenes, butadienes, pentenes, hexenes, heptenes and octenes. The polyolefins may be branched or linear chains and may be of high or low density.

Polyolefins tend to be hydrophobic, making them less desirable for certain applications which require water wettability. In addition, it is especially desirable for such wettability, once imparted to the polyolefin, to be durable. The reason for the desirability of durable wettability is that the products made from these polyolefin fabrics, for example, diapers, may receive multiple liquid insults before being disposed of. Other products in which a durably wettable fabric may find utility are feminine hygiene products, adult incontinence products, wound dressings, bandages and wipers. Wipers may be for industrial use or for home use as countertop or bathroom wipes.

Accordingly, an internal wetting additive may be added to the polyolefin which will produce a polyolefin fiber which is durably wettable.

The internal wetting additive may be added to the polyolefin and compounded in a twin screw extruder in amounts up to 10 weight percent of the blend. Any other method known to those skilled in the art to be effective for the mixing of these components may be used. This mixture may be further blended with neat polyolefin and extruded and fiberized. The fibers or filaments collected to form a web are then bonded, generally thermally, to produce a nonwoven fabric. It has been found that fabrics so produced have unexpectedly durable wettability, resisting removal of this property upon repeated water washings.

The internal wetting additive is of the formula;

$$[[R-\overset{\overset{\displaystyle O}{\|}}{C}-O]_A-[[CH_2-CH_2-O]_x]_B[-\overset{\overset{\displaystyle O}{\|}}{C}-R]_C]_z$$

wherein x is an integer from 1 to 15 and R is an alkane or alkene with up to 18 carbon atoms and A, B, and C are integers equal to or greater than one and may be arranged in any order and z is an integer equal to or greater than one.

A more particular example of the internal wetting additive is represented by the above formula wherein A, B, C and z are equal to one, i.e.;

$$R-\overset{\overset{\displaystyle O}{\|}}{C}-O-[CH_2-CH_2-O]_x-\overset{\overset{\displaystyle O}{\|}}{C}-R.$$

In actual practice, a sample of such an additive will yield molecules having slightly differing values from those desired for x, A, B, C and z but which will have a distribution averaging about the desired values. These molecules are generally characterized as di-fatty acid esters of polyethylene oxide. The di-fatty acid esters were found to be particularly durable when used with polypropylene.

A specific example of the internal wetting additives which is available commercially is DO-400 available from PPG Mazer, Inc. of Gurnee, Ill., a division of PPG Industries, Inc., One PPG Place, Pittsburgh, Pa., 15272.

The internal wetting additive present in the fibers and fabric of this invention is "activated" upon heating. It is believed, though applicant does not wish to be bound by any particular theory, that this activation is a result of increased subsurface to surface migration of the additive caused by heating. Since spunbond and meltblown fabrics are normally subjected to thermal calendering, no additional processing step is necessary for the fabric of this invention beyond that used for conventional spunbond and meltblown fabric formation. Should a method of bonding other than thermal calendering be used, however, a heating step would be necessary for activation and such a method would be equivalent to thermal calendering.

Other methods of imparting wettability to polyolefins, while no doubt sufficient for some applications, generally suffer from a lack of durable wettability. Typical coating operations on polyolefins, for example, result in topical coatings which are easily removed from the fibers with water washing.

The following examples illustrate the superior durable wettability of the instant invention (Examples 2, 3, 5, & 6 are included for comparison and are not of this invention). The mixtures were generally produced by compounding the ingredients in a 30 or 60 mm twin screw extruder. Any other method known to those skilled in the art of compounding polymers as effective may also be used. For the Examples, the mixture was produced by mixing polypropylene with each additive at a level of 10% in a twin screw extruder. The resulting polymer mixture was then dry blended with neat polypropylene in order to reach the percentage of additive mentioned in each Example.

The fabrics were spun at 470° F. (243° C.) at a rate of approximately 0.7 grams/hole/minute. The fabric was bonded by thermal calendering at a pattern roll temperature of 265° F. (129° C.) using an expanded Hansen Pennings pattern with a 15% bond area as taught in U.S. Pat. No. 3,855,046 to Hansen and Pennings. The final basis weight of the bonded fabric was approximately 1 ounce/square yard (osy).

The additives in the Examples are available commercially from PPG Mazer, Inc. The polyolefin used was Exxon Chemical Company's PD3445 polypropylene which has a melt flow rate of 35 g/10 min. The results of the Examples are shown in Table 1.

EXAMPLE 1

Spunbond fabric was produced according to the method described above. The fibers from which the fabric was made had 1 weight percent of dioleate ester of polyethylene oxide with an average molecular weight of 400 (DO-400). Upon thermal bonding the fabric became wettable. In order to test the durability of the wettability of this material to washing with water, 1 inch×6 inch (2.5 cm×15 cm) strips of the fabric were gently agitated in 500 ml of distilled water for one minute, removed and allowed to air dry. This procedure was repeated until the sample became non-wettable. Wettability was determined by placing five drops (approximately 100 microliters each) of water gently on the fabric. Highly wettable materials were instantly wet by all of the drops. Moderately wettable materials imbibed four of the five water droplets within one minute. Unwettable materials were characterized by having the five water drops remain intact on the surface of the fabric for more than five minutes.

EXAMPLE 2

Spunbond fabric was produced as in Example 1. The fibers from which the fabric was made had 1 weight percent of ethoxylated ester of caster oil (CO-8). Upon thermal bonding the fabric became wettable. The fabric was gently agitated in 500 ml of distilled water for one minute, removed and allowed to air dry. This procedure was repeated until the sample became non-wettable. Wettability was determined in the same manner as in Example 1.

EXAMPLE 3

Spunbond fabric was produced as in Example 1. The fibers from which the fabric was made had 1 weight percent of a 50/50 blend of glycerol mono-oleate ester and ethoxylated nonylphenol (GMO/NP-12) as described in U.S. Pat. No. 4,578,414 to Sawyer. Upon thermal bonding the fabric became wettable. The fabric was gently agitated in 500 ml of distilled water for one minute, removed and allowed to air dry. This procedure was repeated until the sample became non-wettable. Wettability was determined in the same manner as in Example 1.

EXAMPLE 4

Spunbond fabric was produced as in Example 1. The fibers from which the fabric was made had 5 weight percent of dioleate ester of polyethylene oxide (DO-400). Upon thermal bonding the fabric became wettable. The fabric was gently agitated in 500 ml of distilled water for one minute, removed and allowed to air dry. This procedure was repeated until the sample became non-wettable. Wettability was determined in the same manner as in Example 1.

EXAMPLE 5

Spunbond fabric was produced as in Example 1. The fibers from which the fabric was made had 5 weight percent of a 50/50 blend of glycerol mono-oleate ester and ethoxylated nonylphenol (GMO/NP-12) as described in U.S. Pat. No. 4,578,414 to Sawyer. Upon thermal bonding the fabric became wettable. The fabric was gently agitated in 500 ml of distilled water for one minute, removed and allowed to air dry. This procedure was repeated until the sample became non-wettable. Wettability was determined in the same manner as in Example 1.

EXAMPLE 6

Spunbond fabric was produced as in Example 1. The fibers from which the fabric was made had 3 weight percent of MAYPEG 400-ML monolaurate. Upon thermal bonding the fabric became wettable. The fabric was gently agitated in 500 ml of distilled water for one minute, removed and allowed to air dry. This procedure was repeated until the sample became non-wettable. Wettability was determined in the same manner as in Example 1.

TABLE 1

| Example | 1 | 2 | 3 | 4 | 5 | 6 |
|---|---|---|---|---|---|---|
| Condition as made | W* | W | W | W | W | W |
| after 1st wash | W | W | NW | W | NW | NW |
| after 2nd wash | W | NW | NW | W | NW | NW |
| after 3rd wash | NW | NW | NW | W | NW | NW |
| after 4th wash | NW | NW | NW | W | NW | NW |

*W Means the fabric was either highly or moderately wettable according to the test procedure described in Example 1, NW means the fabric did not become wet as defined in the test procedure.

The above results clearly show the surprisingly durable wettability of the present invention. At a level of 1 weight percent (Example 1) the fabric made according to this invention had substantially more durable wettability than the fabric of Example 5 which had an additive level of 5%. Example 4, also of a fabric of this invention, had 5 weight percent of the wetting additive and exhibited durable wettability even after the fourth washing.

I claim:

1. A nonwoven fabric having durable wettability comprising fibers formed from polyolefin blended with at least one di-fatty acid ester hydrophilic additive of the formula;

$$[[R-\overset{\overset{\displaystyle O}{\|}}{C}-O]_A-[[CH_2-CH_2-O]_x]_B[-\overset{\overset{\displaystyle O}{\|}}{C}-R]_C]_z$$

wherein x is an integer from 1 to 15, R is selected from the group consisting of alkanes with up to 18 carbon atoms and alkenes with up to 18 carbon atoms, A, B, and C are integers at least equal to one arranged in any order, z is an integer at least equal to one, and wherein said fibers have been formed by providing said at least one hydrophilic additive to said polyolefin prior to fiberization.

2. The nonwoven fabric of claim 1 wherein said hydrophilic additive formula has a value for x of from 7 to 11 and A, B, C and z are equal to 1.

3. The nonwoven fabric of claim 1 wherein said polyolefin is selected from the group consisting of polyethylene and polypropylene.

4. The nonwoven fabric of claim 1 wherein said hydrophilic additive is present in an amount from about 0.1 weight percent to about 10 weight percent.

5. The nonwoven fabric of claim 1 wherein said hydrophilic additive is present in an amount of about 5 weight percent.

6. The nonwoven fabric of claim 1 which is present in an absorbent product selected from the group consisting of diapers, feminine hygiene products, adult incontinence products, wound dressings, bandages and wipers.

7. A nonwoven fabric having durable wettability comprising fibers wherein one of the components is formed from polyolefin blended with di-fatty acid ester hydrophilic additives of the formula;

$$R-\overset{\overset{\displaystyle O}{\|}}{C}-O-[CH_2-CH_2-O]_x-\overset{\overset{\displaystyle O}{\|}}{C}-R$$

wherein x is an integer from 7 to 11 and R is an alkane with up to 18 carbon atoms, in an amount of about 5 weight percent and wherein said fibers have been formed by providing said hydrophilic additives to said polyolefin prior to fiberization.

8. A method of producing a nonwoven fabric having durable wettability which comprises:

(a) forming a blend by thoroughly mixing a polyolefin with at least one di-fatty acid ester hydrophilic additive of the formula;

$$[[R-\overset{\overset{\displaystyle O}{\|}}{C}-O]_A-[[CH_2-CH_2-O]_x]_B[-\overset{\overset{\displaystyle O}{\|}}{C}-R]_C]_z$$

wherein x is an integer from 1 to 15 and R is selected from the group consisting of alkanes with up to 18 carbon atoms and alkenes with up to 18 carbon atoms, A, B, and C are integers at least equal to one arranged in any order, z is an integer at least equal to one;

(b) melting said blend;

(c) fiberizing said blend by extrusion through a plurality of fine capillaries;

(d) depositing said fiberized blend on a collecting surface to form a randomly dispersed web; and, (e) thermally bonding said fiberized blend web.

9. The method of claim 8 wherein A, B, C and z are equal to one.

* * * * *